US010841686B2

(12) United States Patent
Brace

(10) Patent No.: US 10,841,686 B2
(45) Date of Patent: Nov. 17, 2020

(54) ACCOMMODATING EAR PADS

(71) Applicant: Neal John Brace, Grand Rapids, MI (US)

(72) Inventor: Neal John Brace, Grand Rapids, MI (US)

( * ) Notice: Subject to any disclaimer, the term of this patent is extended or adjusted under 35 U.S.C. 154(b) by 77 days.

(21) Appl. No.: 16/109,503

(22) Filed: Aug. 22, 2018

(65) Prior Publication Data

US 2019/0069065 A1 Feb. 28, 2019

Related U.S. Application Data

(63) Continuation-in-part of application No. 29/641,499, filed on Mar. 22, 2018, now Pat. No. Des. 868,025.

(60) Provisional application No. 62/549,347, filed on Aug. 23, 2017.

(51) Int. Cl.
*H04R 1/10* (2006.01)

(52) U.S. Cl.
CPC ..... *H04R 1/105* (2013.01); *H04R 1/1008* (2013.01); *H04R 1/1058* (2013.01); *H04R 1/1066* (2013.01)

(58) Field of Classification Search
CPC .... H04R 1/105; H04R 1/1008; H04R 1/1058; H04R 1/1066
USPC ..... 381/371
See application file for complete search history.

(56) References Cited

U.S. PATENT DOCUMENTS 4,856,118 A 8/1989 Sapiejewski
5,724,119 A 3/1998 Leight
5,924,138 A 7/1999 Baisden
8,605,935 B1 * 12/2013 Huang ..... G02C 11/10 381/381
D724,559 S 3/2015 Reaux
9,049,512 B1 6/2015 Kulavik et al.
2014/0286520 A1 9/2014 Ogino
2016/0057524 A1 * 2/2016 Kulavik ..... G06F 3/165 381/74
2017/0094400 A1 3/2017 Willman

FOREIGN PATENT DOCUMENTS

CN 202261724 U 5/2012
CN 205987288 U 2/2017
CN 206272815 U 6/2017
JP 5046172 B1 10/2012

OTHER PUBLICATIONS

PCT Application No. PCT/US2018/047773, International Search Report and Written Opinion dated Nov. 2, 2018.

* cited by examiner

*Primary Examiner* — Sean H Nguyen
(74) *Attorney, Agent, or Firm* — Larry E. Henneman, Jr.; Henneman & Associates, PLC

(57) ABSTRACT

A novel ear pad includes a lateral surface and a medial surface. The lateral surface is adapted to be coupled to a headset and the medial surface includes a recess that accommodates the passage of an article between the ear pad and a user's head. In a particular embodiment, the recess is contoured to receive an eyeglass temple. In another embodiment, an ear pad includes an annular wall having an inferior portion and a superior portion wherein the wall thickness of the inferior portion is greater than the wall thickness of the superior portion.

20 Claims, 10 Drawing Sheets

ACCOMMODATING EAR PADS

RELATED APPLICATIONS

This application claims the benefit of U.S. Provisional Patent Application No. 62/549,347, filed on Aug. 23, 2017, by the same inventor, which is incorporated herein by reference in its entirety. This application is also a continuation in part of co-pending U.S. Design patent application Ser. No. 29/641,499, filed on Mar. 22, 2018, by the same inventor, which is incorporated herein by reference in its entirety.

BACKGROUND OF THE INVENTION

Field of the Invention

This invention relates generally to headsets, and more particularly to ear pads configured to accommodate eyewear, headwear, or other articles worn or carried by a user.

Description of the Background Art

Ear pads are essential to the comfort of various types of headsets such as, for example, audio headphones, sound-dampening ear muffs, noise canceling headsets, etc. One challenge in manufacturing and designing headsets is achieving a universal fit that will provide comfort to all users which, for course, have a wide range of head and ear size and shape. One way manufacturers achieve a universal fit for all users is by making the ear pads large enough to fit around the ears and engage the head rather than urge against the ears. However, such ear pads also have drawbacks. For example, they are extremely uncomfortable for users who wear eyewear because such ear pads urge the rigid arms of eye glasses against the user's head. As a result, user's either deal with the discomfort or remove the eye glasses altogether. As another drawback, the temples of eyewear break the seal between the ear pads and the user's head, thus degrading the sound attenuation function of the ear pads.

What is needed, therefore, is a headset that can be more comfortably worn by a user wearing eye glasses and/or other head-worn articles without breaking the seal between the user's head and the ear pads.

SUMMARY

The present invention overcomes the problems associated with the prior art by providing headsets and/or ear pads that accommodate eyewear, headwear, and/or other articles worn or carried by a user. Aspects of the invention facilitate the proper positioning of such articles without interfering with the contact between the ear pads and a user's head.

An example ear pad includes an annular body. The annular body includes a lateral surface, configured to be coupled to a headset, and a medial surface, configured to contact a user's head around an ear of the user. The annular body defines a recess (e.g., a notch) in a superior, medial portion of the annular body. The recess facilitates the positioning of an article therein, without breaking contact between the medial surface and the user's head around the ear of the user.

In a particular example embodiment, the recess has a width sufficient to accommodate an eyewear temple. In addition, the recess can be contoured to engage an inferior surface of the eyewear temple. A portion of the annular body defining the recess remains spaced apart from the user's head when the medial surface is in contact with the user's head.

In the example embodiment, the annular body includes an annular wall adjacent the medial surface, and the annular wall is configured to completely surround the ear of the user. A thickness (e.g., measured in the vertical direction) of an inferior portion of the annular wall is greater than a thickness of a superior portion of the annular wall. A top surface of the superior portion of the annular wall forms a bottom, inner surface of the recess. Optionally, the annular wall includes sound attenuating material.

Optionally, the ear pad can include an adhesive layer disposed on the lateral surface to facilitate fastening the ear pad to the headset. As another option, the ear pad can include a rigid mechanical fastener coupled to the lateral surface. The rigid mechanical fastener facilitates the removable/detachable coupling of the ear pad to the headset.

An example headset is also disclosed. The example headset includes a frame, a first ear piece, a second ear piece, a first annular ear pad, and a second annular ear pad. The frame includes a first end, a second end, and an intermediate portion coupled therebetween. The first ear piece is coupled to the first end of the frame, and the second ear piece is coupled to the second end of the frame. The first annular ear pad is coupled to the first ear piece, and the second annular ear pad is coupled to the second ear piece. Each of the first annular ear pad and the second annular ear pad includes a lateral surface configured to be coupled to a respective one of the first ear piece and the second ear piece. In addition, each of the first annular ear pad and the second annular ear pad includes a medial surface configured to contact a user's head around a respective ear of the user. Furthermore, each of the first annular ear pad and the second annular ear pad defines a recess in a superior, medial portion of the first annular ear pad and the second annular ear pad. Each of the recesses facilitates the positioning of an article therein, without breaking contact between the medial surfaces of the first and second annular ear pads and the user's head, around the ears of the user.

In an example embodiment, each of the recesses has a width sufficient to accommodate an eyewear temple. In addition, each recess is contoured to engage an inferior surface of an eyewear temple. Optionally, a portion of each annular ear pad defining the recesses remains spaced apart from the user's head when the medial surfaces are in contact with the user's head.

In an example embodiment, each of the first annular ear pad and the second annular ear pad includes an annular wall adjacent the medial surface, and each annular wall is configured to completely surround the respective ear of the user. A thickness (e.g., measured in the vertical direction) of an inferior portion of each the annular wall is greater than a thickness of a superior portion of each the annular wall. Optionally, the annular walls include sound attenuating material.

Each of the first annular ear pad and the second annular ear pad can be coupled to a respective one of the first ear piece and the second ear piece by an adhesive. Alternatively or additionally, each of the first annular ear pad and the second annular ear pad can be removably coupled to a respective one of the first ear piece and the second ear piece by a respective mechanical fastener.

An example method for manufacturing an ear pad is also disclosed. The example method includes forming a lateral surface configured to be coupled to a headset, and forming a medial surface configured to contact a user's head around an ear of the user. The method additionally includes forming an annular body defining a recess in a superior, medial portion of the annular body. The recess is configure to facilitate the positioning of an article therein, without breaking contact between the medial surface and a user's head around the ear of the user. The method additionally includes coupling the annular body between the lateral surface and the medial surface.

An example method for manufacturing a headset is also disclosed. The example method includes providing a frame having a first, a second end, and an intermediate portion disposed therebetween. The method additionally includes providing an ear piece, coupling the ear piece to the first end of the frame, and providing an ear pad. The ear pad includes a lateral surface, a medial surface, and a recess adjacent the medial surface. The medial surface is adapted to engage a user's head, and the recess facilitates the positioning of an article therein, without breaking contact between the medial surface and the user's head around the ear of the user. The method additionally includes attaching the lateral surface of the ear pad to the ear piece.

Another example ear pad includes a lateral surface, a medial surface, and an annular wall adjacent the medial surface. The lateral surface is adapted to be coupled to a headset, and the medial surface is adapted to contact a user's head around an ear of the user. The annular wall is configured to completely surround the ear of the user. In an example embodiment, the annular wall includes a superior portion having a first thickness (e.g., measured in the vertical direction) and an inferior portion having a second thickness. The second thickness is greater than the first thickness.

BRIEF DESCRIPTION OF THE DRAWINGS

The present invention is described with reference to the following drawings, wherein like reference numbers denote substantially similar elements.

DETAILED DESCRIPTION

The present invention overcomes the problems associated with the prior art, by providing ear pads configured to receive portions of articles (e.g., the arms of eyewear, band of a hat, etc.) worn or carried by a user. In the following description, numerous specific details are set forth (e.g., material types, fastening means, size, etc.) in order to provide a thorough understanding of the invention. Those skilled in the art will recognize, however, that the invention may be practiced apart from these specific details. In other instances, details of well-known manufacturing practices (e.g., molding, assembling, adhering, etc.) and components have been omitted, so as not to unnecessarily obscure the present invention.

In the description that follows, anatomical terms are used to describe positional relationships between features of the headsets/ear pads. The terms are used with the understanding that a headset and attached ear pads are being worn on the head of a user in a normal manner, and the terms relate to the anatomical position of the wearer, not the ear pad itself. For example, a medial surface of an ear pad is the surface that is close to the middle of the wearer's head, not the middle of the ear pad itself.

Figure 1:
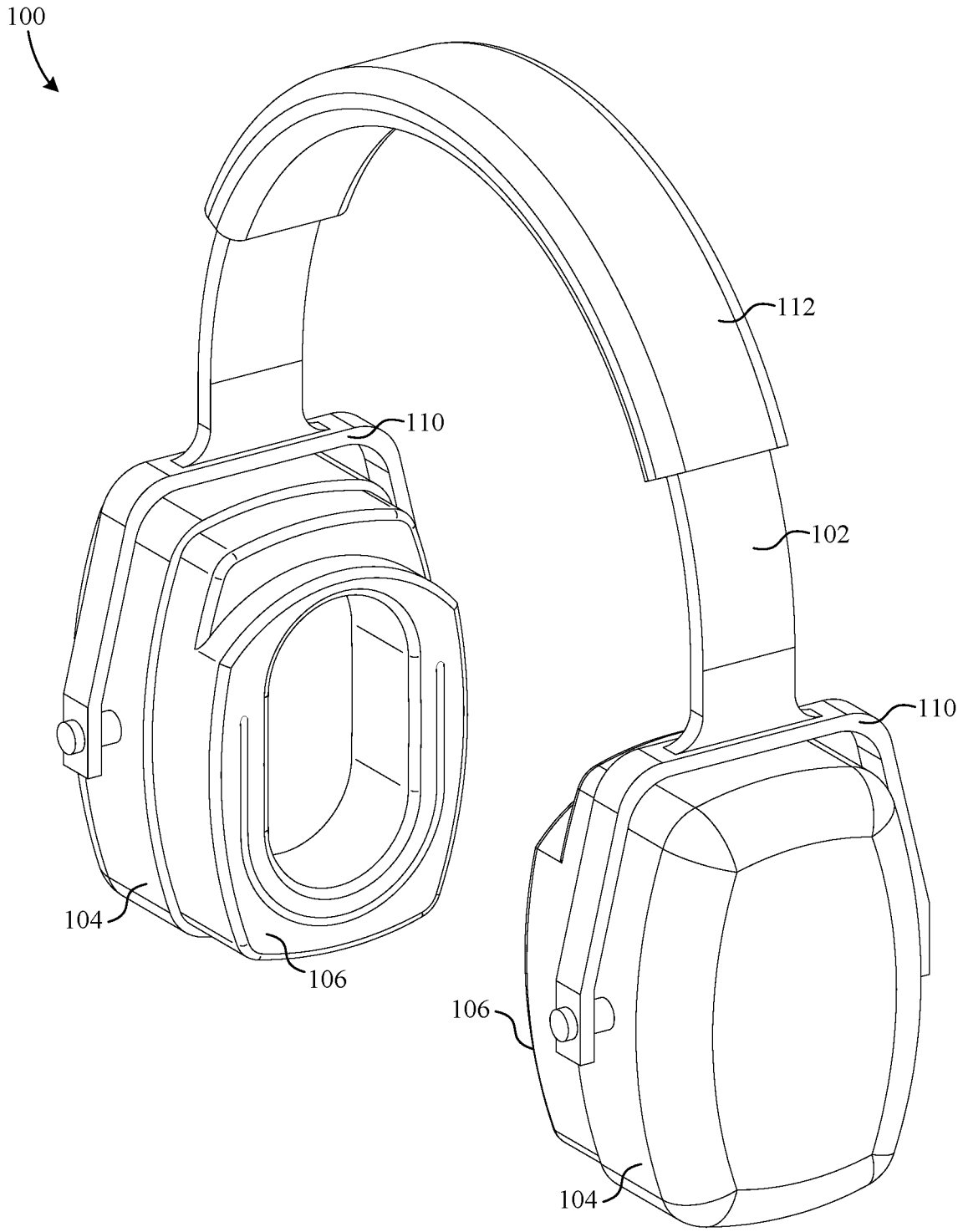
FIG. 1 is a perspective view of a set of ear pads attached to a headset.

FIG. 1 shows a perspective view of a headset 100, according to one example embodiment of the present invention. In the example embodiment, headset 100 is a pair of sound attenuating (e.g., hearing protection) ear muffs. However, those skilled in the art will recognize that headset 100 can be any type of headset, without departing from the scope of the present invention. For example, headset 100 can be of any type of headset including, but not limited to, audio headphones, sound amplifying headset, noise compression ear muffs, ear warmers, noise cancellation headset, etc. Ear pieces of any particular headset will depend on the particular function of the headset, but the ear pads disclosed herein may be used in conjunction with any of such ear piece types, with or without slight modification.

Headset 100 includes a frame 102, a set of ear cups 104, and a set of ear pads 106. Frame 102 includes an intermediate portion 108 disposed between two end portions 110. Intermediate portion 108 includes a head pad 112 configured to comfortably engage the superior surface of a user's head. Each of ear cups 104 is hingably coupled to a respective one of end portions 110 of frame 102, to accommodate varying user head sizes and shapes. Furthermore, ear cups 104 include rigid shells which provide structure to headset 100 and also serve to attenuate sound. Although not visible, ear cups 104 house sound attenuating materials including, but not limited to, foam, gel, etc.

Each of ear pads 106 are fixed to a respective one of ear cups 104 and are configured to comfortably contact opposite sides of a user's head, thereby forming at least a partial acoustical seal completely around the user's ears. As will be described in further detail with reference to upcoming figures, ear pads 106 allow a user to comfortably wear additional head-worn articles (e.g., eye glasses, hat, headband, etc.) without breaking the seal/contact between ear pads 106 and the user's head.

Figure 2:
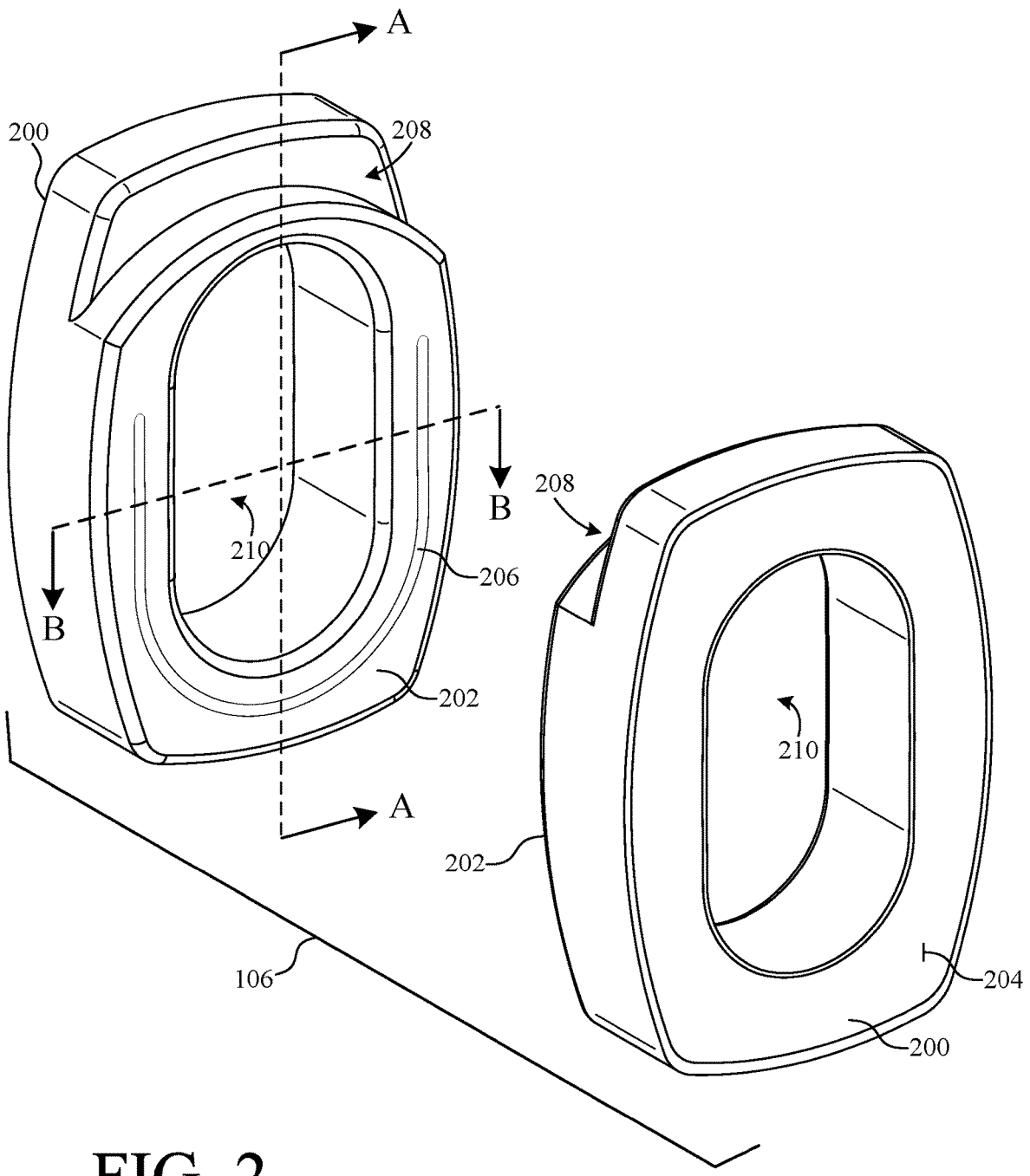
FIG. 2 is a perspective view of the ear pads of FIG. 1 removed from the headset.

FIG. 2 shows a perspective view of ear pads 106 removed from headset 100. Each of ear pads 106 includes a soft, annular body that both attenuates sound and compresses slightly when headset 100 is worn by a user. Each of ear pads 106 includes a lateral surface 200 coupled to an opposite facing medial surface 202 by the annular body.

Lateral surfaces 200 are adapted to be coupled to head set 100. In the example embodiment, lateral surface 200 includes an adhesive layer 204 formed thereon. Adhesive layer 204 facilitates the fastening of ear pad 106 to ear cup 104 of headset 100. Alternatively, adhesive layers 204 may be substituted with solid mechanical features (e.g., tabs, snap features, slots, hook and loop material, channels, complementary interlocking features, etc.) that allow ear pads 106 to be removably attached to ear cups 104. As another alternative, resilient boots extending, for example, from the peripheral edge of lateral surface 200, may be used to attach lateral surfaces 200 to ear cups 104.

Medial surfaces 202 are adapted to comfortably contact a user's head. Each respective medial surface 202 defines a U-channel 206. U-channel 206 is formed partially around an aperture 210 formed through each of ear pads 106. Furthermore, U-channels 206 are mechanical features that flex to increase the compressibility of ear pads 106, thereby making them more comfortable for the user to wear.

The annular body of each ear pad 106 defines a recess 208 adjacent medial surface 202. Recess 208 is formed on a medial, superior portion of ear pad 106 to facilitate the positioning of an article (e.g., eyeglass temples, hats, headbands, etc.) in recess 208 and adjacent the temple region of a user's head, without breaking the contact between medial surface 202 and the user's head.

Indeed, recess 208 makes ear pads 106 much more comfortable to wear than prior ear pads, when the user is also wearing additional head-worn articles. For example, recess 208 reduces the elevation of eyewear temples with respect to the ear of a user and, therefore, reduces the tilt of the eyewear to an acceptable level. As another example, recess 208 allows a hat or cap worn by a user to be pulled down farther over a user's head to a more natural position.

Figure 3:
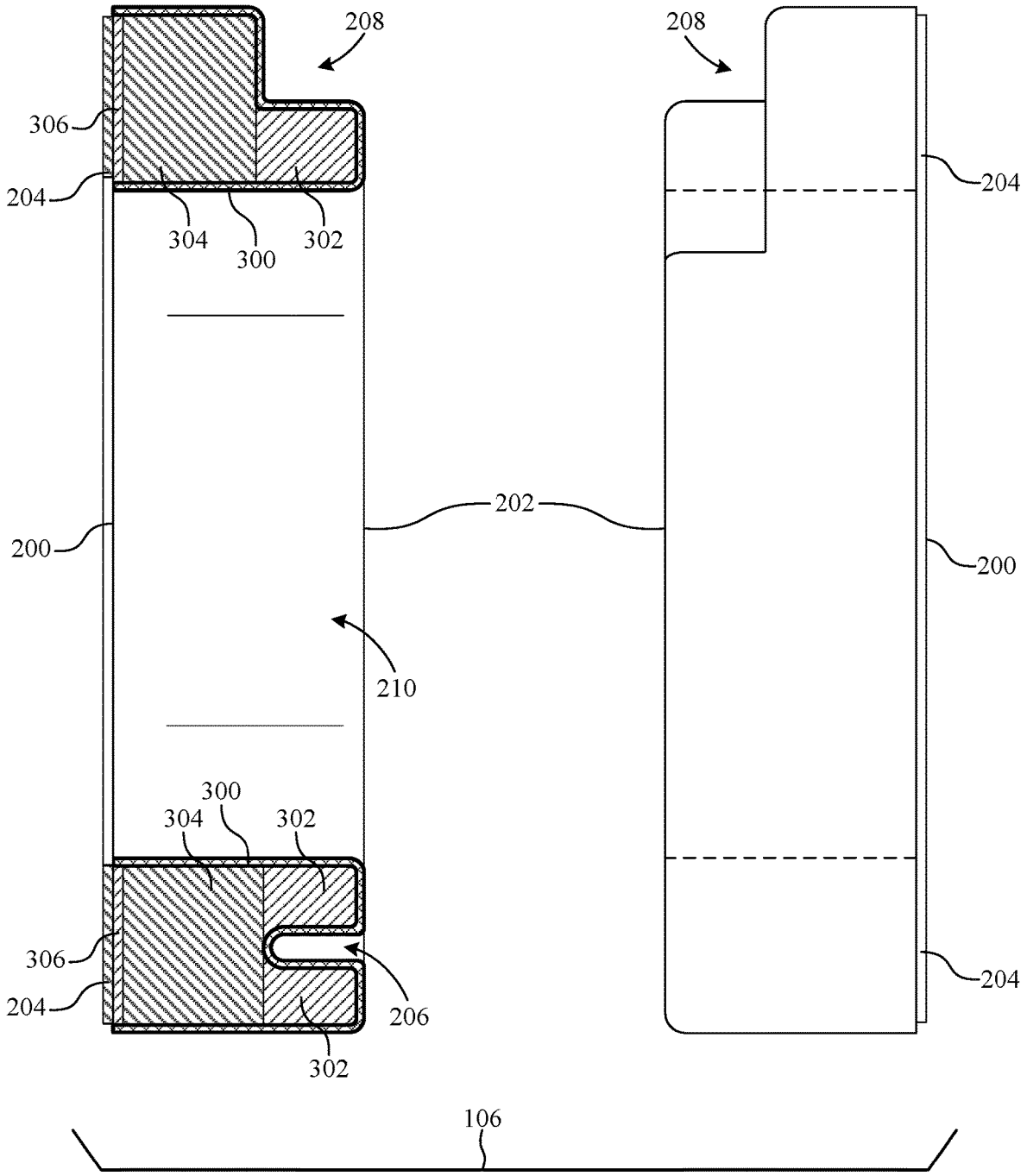
FIG. 3 is a cross-sectional view of the ear pads of FIG. 2 taken along line A-A.

FIG. 3 shows a front view of ear pads 106, wherein the right-hand (relative to the user) one of ear pads 106 is shown sectioned along line A-A of FIG. 2. In this example, ear pad 106 is formed from an outer shell 300, a gel layer 302, a foam layer 304, and a backing 306. Outer shell 300 is a thin, soft, and pliable shell formed by vacuum molding a sheet of polyurethane in a negative mold. Once shell 300 is formed, gel layer 302 is formed by pouring liquid silicone into the interior cavity of shell 300 until shell 300 is filled to the level at which recess 208 ends. Shell 300 is rotated 90 degrees clock-wise from the orientation shown in FIG. 3 during the formation of gel layer 302 and subsequent processing steps. Once gel layer 302 is formed, foam layer 304 is formed by inserting a pre-cut annular piece of open-cell foam into the interior cavity of shell 300, on top of gel layer 302. Then, backing 306, which has the same footprint as foam layer 304, is also inserted into the interior cavity of shell 300 (or just at the opening into shell 300), on top of foam layer 304. In this example, backing 306 is formed from a flexible, die-cut piece of polyethylene terephthalate glycol (PETG). However, any suitable material that is thin, soft, and/or pliable can be used to make backing 306, including, but not limited to, the same material used to form outer shell 300. Once backing 306 is in place, the interface between shell 300 and backing 306 is fused by a thermal process such as, for example, laser-welding, reheating, etc. Finally, adhesive is distributed on the external surface of backing 306, thereby forming adhesive layer 204 on lateral surface 200 of ear pad 106.

Adhesive layer 204 can be used to adhere ear pad 106 directly to an ear piece of a head set or to an interface structure (not shown) that can be mechanically coupled to a particular type/style of ear piece. The use of the mechanical interface(s) allows ear pad 106 to be coupled to a wide variety of ear pieces, without requiring modification/redesign of ear pads 106 for each style of ear piece. In an example embodiment, the mechanical interface is an injection molded, annular, rigid polymer plate having a flat medial surface and the male portion of a snap-fit annular ring formed on the lateral surface. Ear pad 106 can be adhered directly to the flat medial surface, and the male portion of the snap-fit annular ring engages a complementary female portion of the snap-fit annular ring formed on an ear piece. The mechanical interface can be formed from any suitable material including, but not limited to, polycarbonate, arcylonnitrile butadiene styrene (ABS), nylon, and so on.

Ear pads 106 are symmetrical about the cross-sectional plane of line A-A. As a result, identical ear pads 106 can be used on either the left or right one of ear cups 104. This simplifies the manufacture, sale, and use of ear pads 106, as well as the assembly of headset 100.

Figure 4:
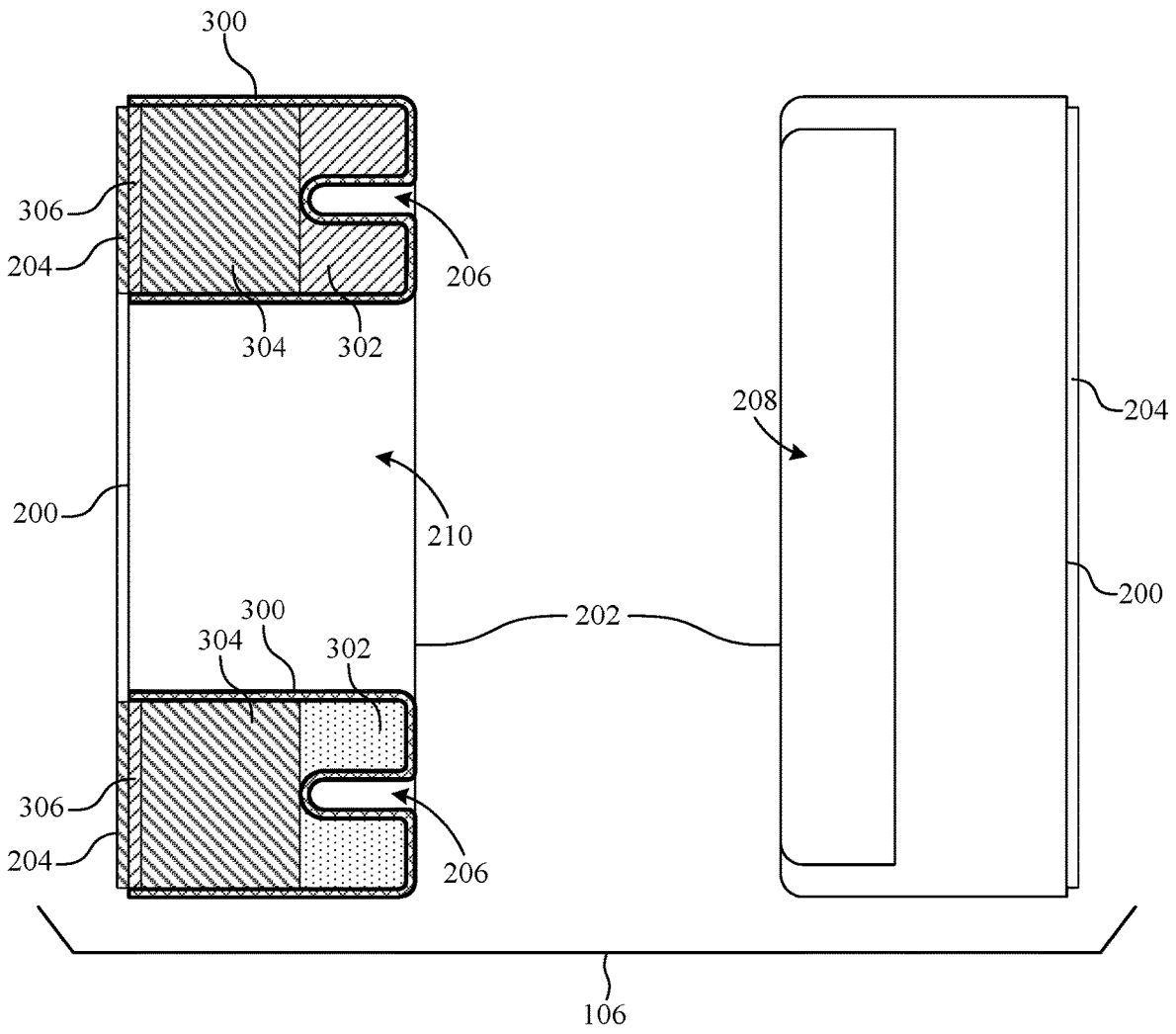
FIG. 4 is a cross-sectional view of the ear pads of FIG. 2 taken along line B-B.

FIG. 4 shows a top-view of ear pads 106, wherein the right-hand (relative to the user) one of ear pads 106 is shown sectioned along line B-B of FIG. 2. As shown, U-channel 206 extends around from the front to the rear of ear pad 106 and is as deep as gel layer 302 so that medial surface 202 can easily compress and conform to the user's head. U-channel 206 increases the pliability of medial surface 202 and, therefore, increases the comfort of ear pads 106.

Figure 5:
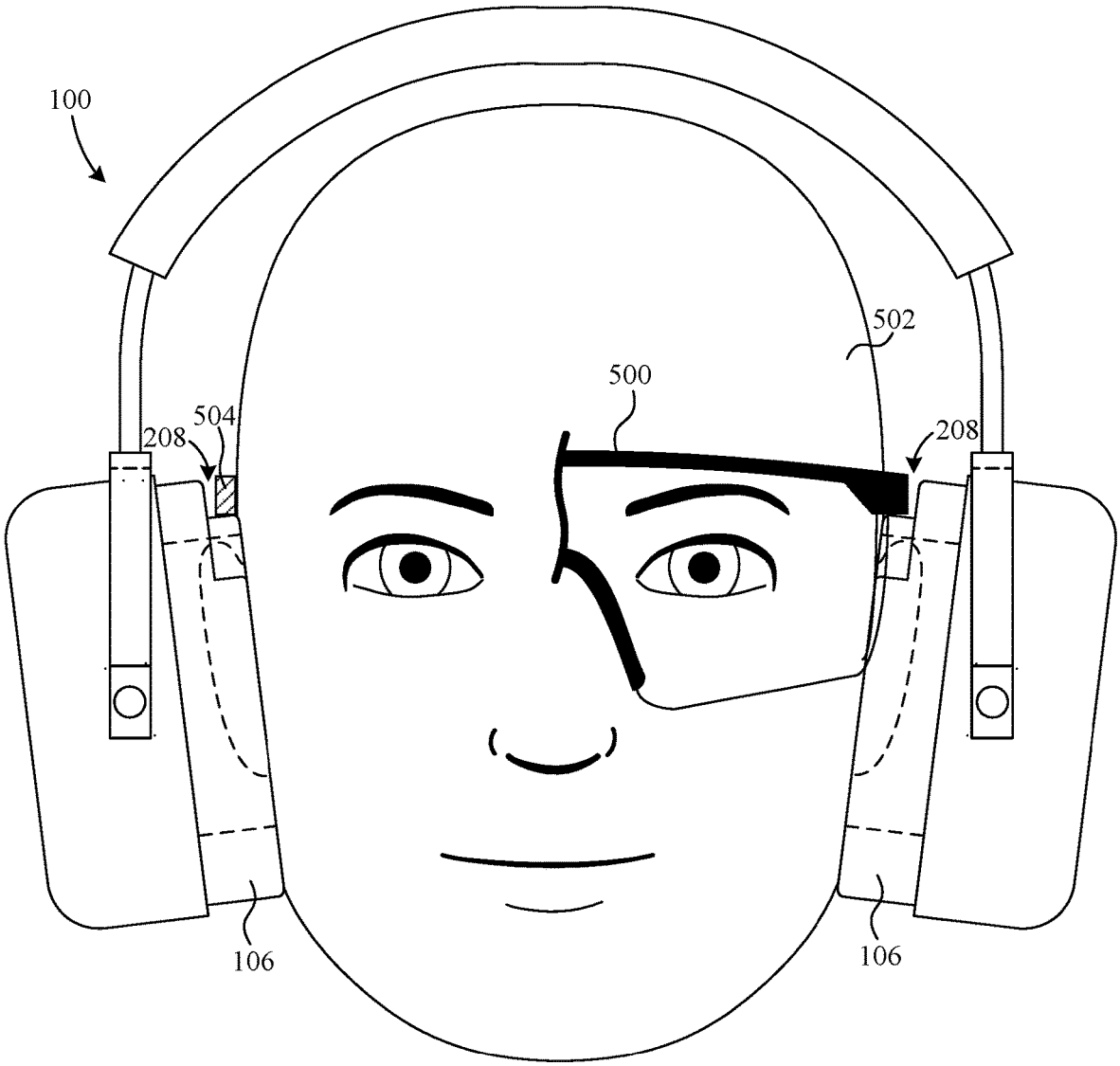
FIG. 5 is a front view of the headset of FIG. 1 being worn by a user.

FIG. 5 shows a front view of headset 100 and a set of eyewear 500 being worn by a user 502. The right-hand side (relative to user 502) of the frame and lens of eyewear 500 is cut away and the right temple is shown sectioned to more clearly illustrate the functionality of ear pads 106. Temples 504 of eyewear 500 abut the temple regions of user 502 while disposed in recesses 208, but are not urged against by ear pads 106. Indeed, recesses 208 allow user 502 to comfortably wear eyewear 500 with headset 100, because the width of each recess 208 (in the horizontal direction) is greater than the thickness of each temple 504, and the vertical wall of each recess 208 remains a spaced distance from the head of the wearer. In addition, the depth of each recess 208 reduces the downward tilt of eyewear 500.

Figure 6:
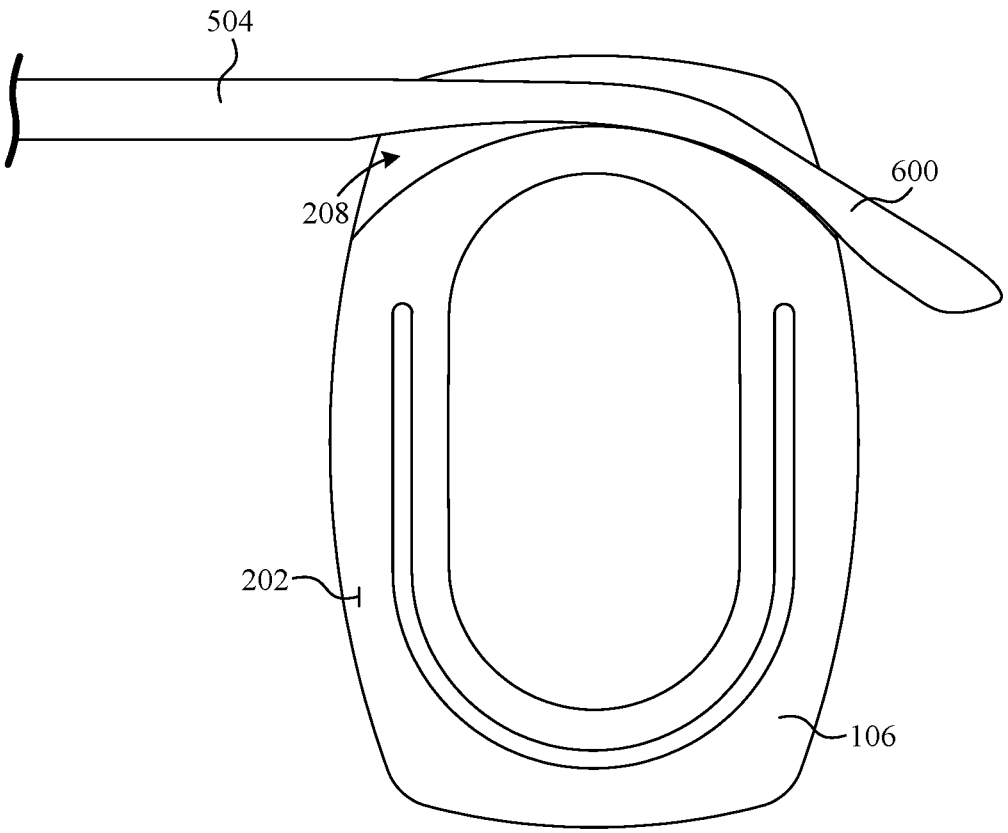
FIG. 6 is a plan view of a medial surface of an ear pad of FIG. 5 having an eyeglass temple disposed in a recess of the ear pad.

FIG. 6 shows a plan view of temple 504 disposed in recess 208 of ear pad 106. As shown, recess 208 is contoured such that medial surface 202 engages the inferior surface of temple 504. This allows temples 504 having downward-curved temple tips 600 to sit in recess 208 without excessive forward tilting of the eyewear with respect to the user's head. It also serves to prevent eyewear 500 from falling off the user when the user looks down.

Figure 7:
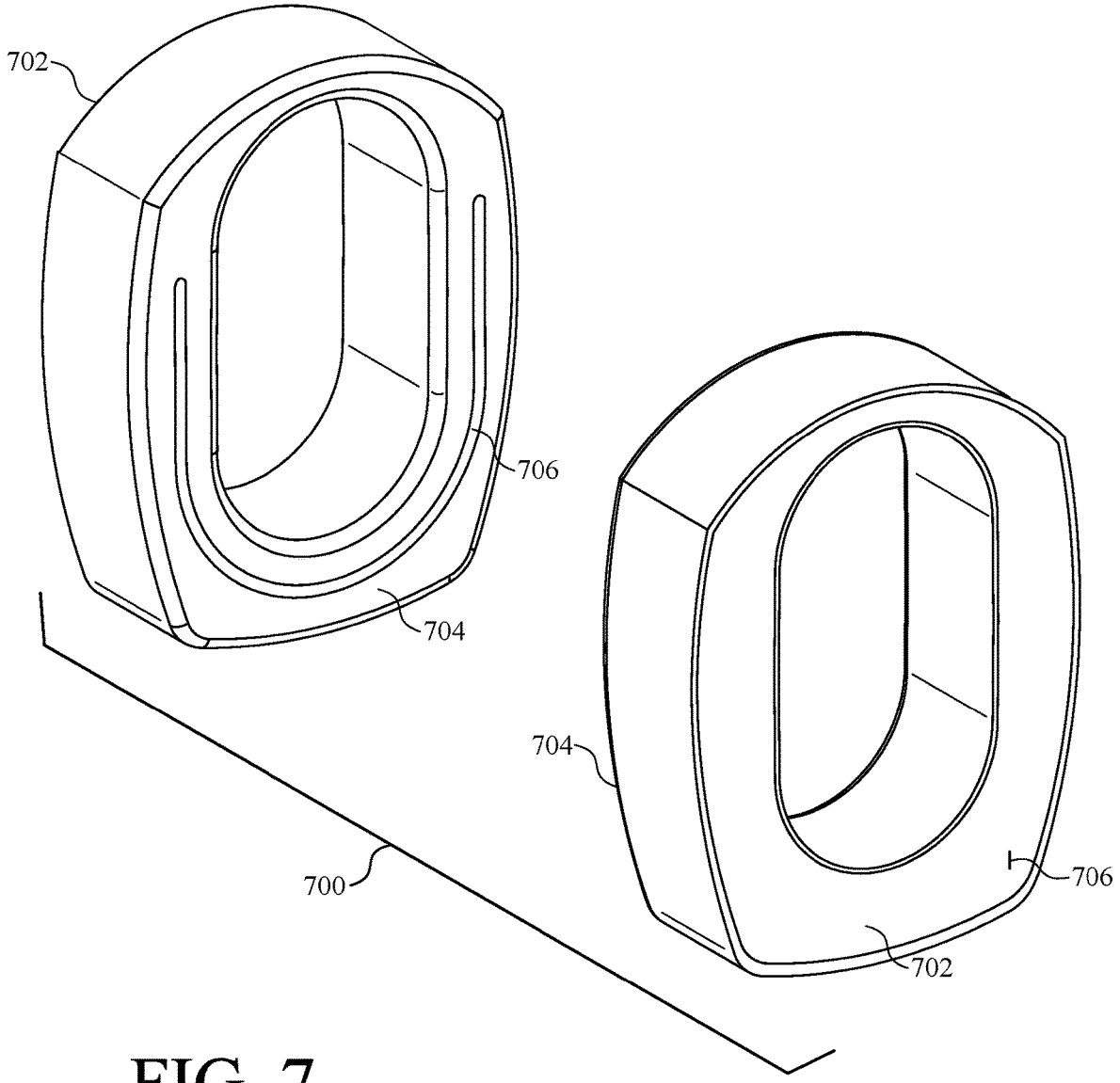
FIG. 7 is a perspective view of a set of ear pads according to an alternate embodiment.

FIG. 7 shows a perspective view of another example set of ear pads 700. Each of ear pads 700 includes a soft, annular body that both attenuates sound and compresses slightly when the hosting headset is worn by a user. Each of ear pads 700 includes a lateral surface 702 and an opposite facing medial surface 704. Lateral surface 702 is adapted to be mounted to a headset by, for example, an adhesive layer 706 formed thereon. Alternatively, lateral surface 702 may include a mechanical fastening feature (e.g., rigid slots, snaps, hooks, hook and loop fasteners, complementary interlocking features, etc.) and/or a resilient boot that compression fits around a portion of ear cup 104. Medial surface 704 is adapted to contact a user's head and form at least a partial acoustical seal completely around the user's ear, when ear pad 700 is urged against the user's head. Medial surface 704 also includes a U-channel 706 that is identical to U-channel 206 of ear pad 106 and, therefore, not described in further detail to avoid redundancy.

Figure 8:
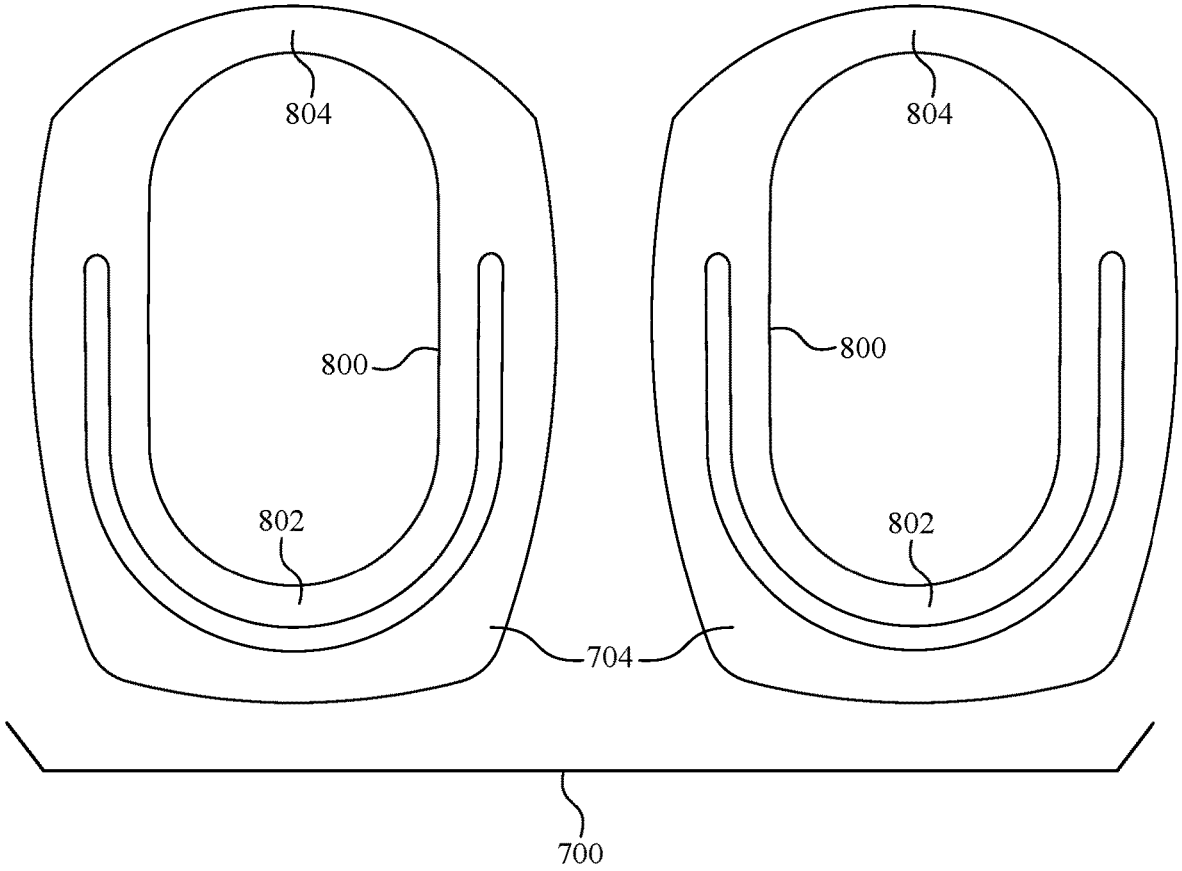
FIG. 8 is a plan view of the medial surfaces of the ear pads of FIG. 7.

FIG. 8 is a plan view of medial surfaces 704 of ear pads 700. Each of medial surfaces 704 defines an annular wall 800 having an inferior portion 802 and a superior portion 804. Inferior portion 802 has a wall thickness (in the vertical direction) that is greater than the wall thickness of superior portion 804, such that an article (e.g., eyeglass temples, hat, headband, etc.) resting on the top of superior portion 804 will be closer to the wearer's ear, as compared to known ear pads. The proximity to the user's ear provides the same advantages as ear pads 106 described above. Furthermore, the wall thickness differential is such that minimal sound attenuation is sacrificed to provide these advantages.

Figure 9:
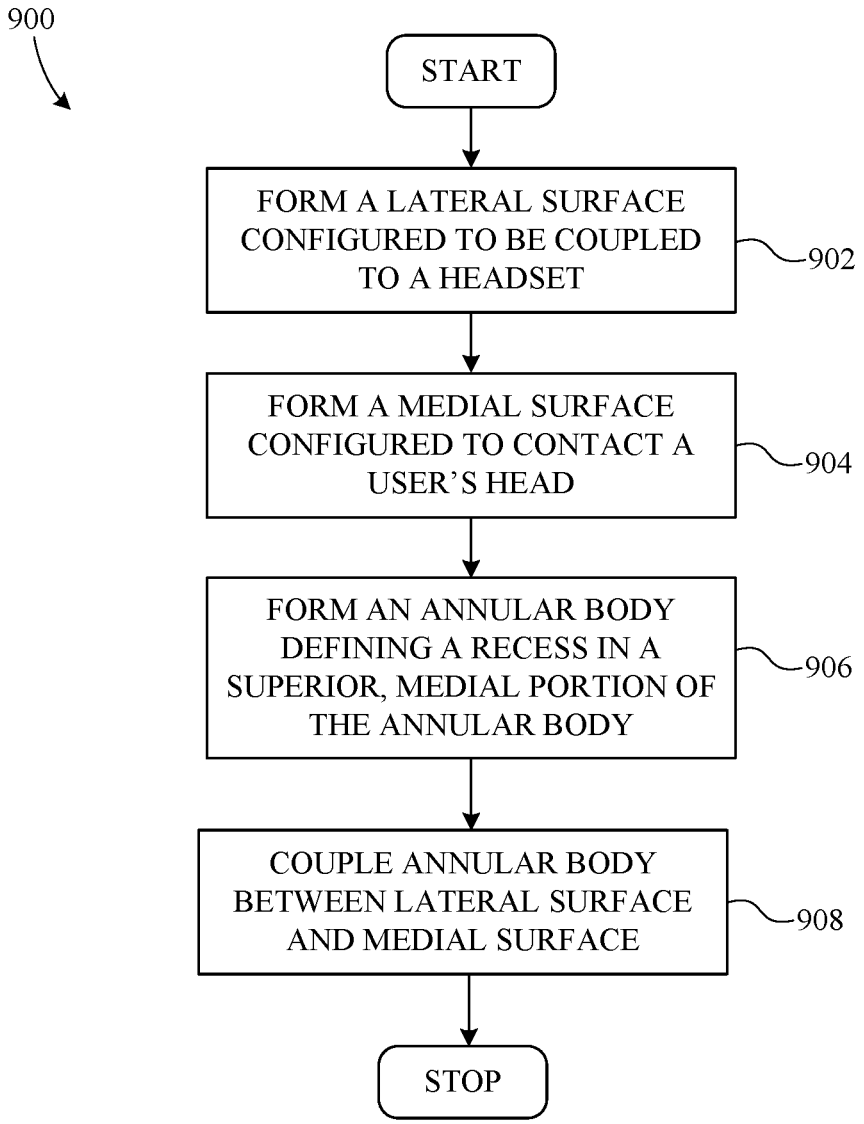
FIG. 9 is a flowchart summarizing a method of manufacturing an ear pad.

FIG. 9 is a flowchart summarizing an example method 900 of manufacturing an ear pad. In a first step 902, a lateral surface configured to be coupled to a headset is formed. Next, in a second step 904, a medial surface configured to contact a user's head is formed. Then, in a third step 906, an annular body including a recess in a superior medial portion of the annular body is formed. Finally, in a fourth step 908, the annular body is coupled between the lateral surface and the medial surface.

Figure 10:
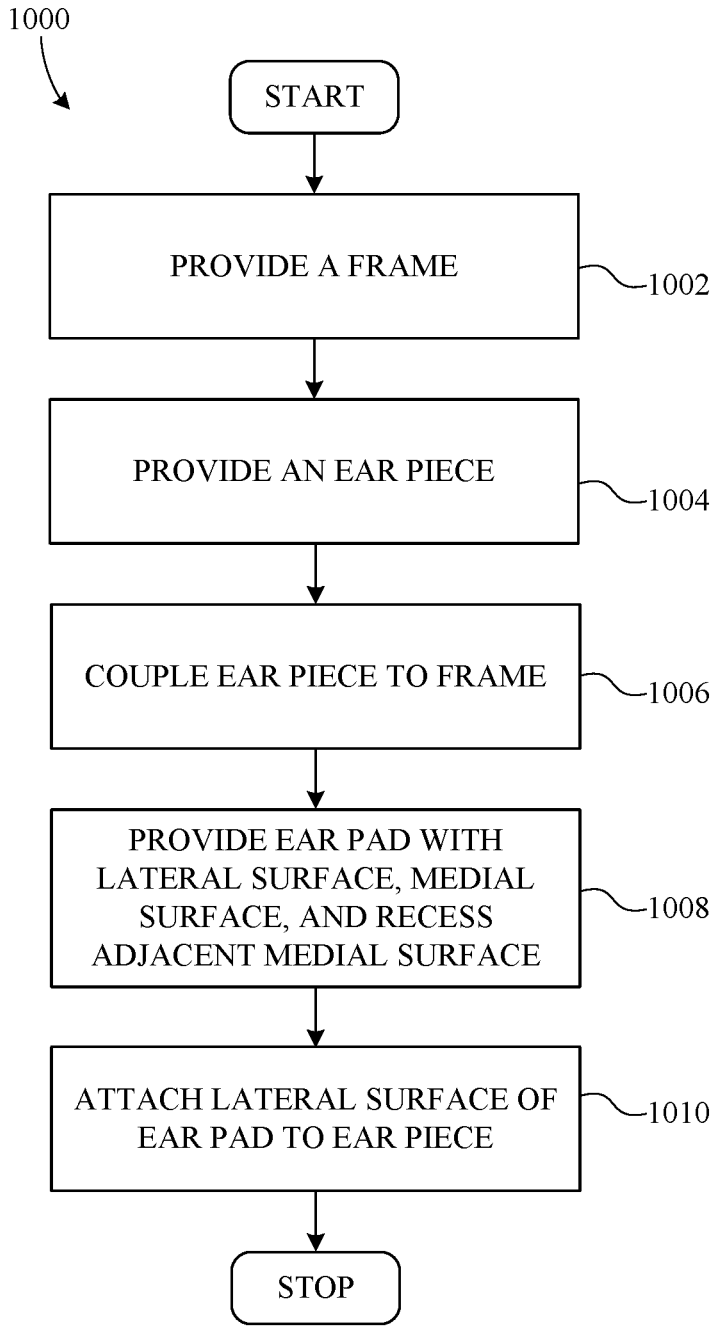
FIG. 10 is a flowchart summarizing a method of manufacturing a headset.

FIG. 10 is a flowchart summarizing an example method 1000 of manufacturing a headset. In a first step 1002, a frame is provided. Then, in a second step 1004, an ear piece is provided. Next, in a third step 1006, the ear piece is coupled to the frame. Then, in a fourth step 1008, an ear pad with a lateral surface, a medial surface, an a recess adjacent the medial surface is provided. Next, in a fifth step 1010, the lateral surface is coupled to the headset.

The description of particular embodiments of the present invention is now complete. Many of the described features may be substituted, altered or omitted without departing from the scope of the invention. For example, alternate materials (e.g., foam, rubber, etc.), may be substituted for the layers of the ear pad. As another example, alternate headset types (e.g., audio headphones, ear warmers, telephone headsets, etc.), may be substituted for the sound attenuating ear muffs. These and other deviations from the particular embodiments shown will be apparent to those skilled in the art, particularly in view of the foregoing disclosure.

In addition, although ear pads 106 and 700 are described herein as components of a headset, the ear pads need not be provided in conjunction with a headset. Rather, the innovative ear pads can be acquired separately and used to replace existing ear pads on a headset.

I claim:

1. An ear pad comprising:

an annular body; and wherein said annular body includes a lateral surface, a medial surface, and a top surface, said lateral surface being configured to be coupled to a headset;

said medial surface includes a continuous contact surface configured to contact a user's head completely around an ear of said user;

said top surface of said annular body includes a first region, a second region, and an intermediate region, said intermediate region and said second region defining a recess in a superior, medial portion of said annular body;

said first region of said top surface extends transversely from said lateral surface of said annular body toward said medial surface of said annular body;

said intermediate region of said top surface extends downwardly from said first region of said top surface to said second region of said top surface;

said second region of said top surface extends transversely from said intermediate region of said top surface to said medial surface of said annular body; and said recess facilitates the positioning of an article therein and in contact with said user's head, without breaking contact between said contact surface and said user's head around said ear of said user.

2. The ear pad of claim 1, wherein said second region of said top surface of said annular body has a width sufficient to accommodate an eyewear temple.

3. The ear pad of claim 2, wherein said second region of said top surface of said annular body is contoured to engage an inferior surface of said eyewear temple.

4. The ear pad of claim 1, wherein a portion of said intermediate region of said top surface of said annular body remains spaced apart from said user's head when said medial surface is in contact with said user's head.

5. The ear pad of claim 1, wherein said annular body includes an annular wall adjacent said medial surface and configured to completely surround said ear of said user.

6. The ear pad of claim 5, wherein said annular wall includes sound attenuating material.

7. The ear pad of claim 5, wherein a thickness of an inferior portion of said annular wall is greater than a thickness of a superior portion of said annular wall.

8. The ear pad of claim 1, further comprising an adhesive layer disposed on said lateral surface to facilitate fastening said ear pad to said headset.

9. The ear pad of claim 1, further comprising a rigid mechanical fastener coupled to said lateral surface, said rigid mechanical fastener facilitating the removable coupling of said ear pad to said headset.

10. A headset comprising:

a frame having a first end, a second end, and an intermediate portion coupled therebetween;

a first ear piece coupled to said first end of said frame;

a second ear piece coupled to said second end of said frame;

a first annular ear pad coupled to said first ear piece; and a second annular ear pad coupled to said second ear piece; and wherein each of said first annular ear pad and said second annular ear pad includes a lateral surface, a medial surface and a top surface, said lateral surface being configured to be coupled to a respective one of said first ear piece and said second ear piece;

each of said medial surfaces includes a continuous contact surface configured to contact a user's head completely around a respective ear of said user;

each said top surface of said respective first annular ear pad and said second annular ear pad includes a first region, a second region, and an intermediate region;

each said first region extends transversely from said lateral surface toward said medial surface of said respective annular ear pad;

each said intermediate regions extends downwardly from said first region to said second region of said respective annular ear pad;

each said second region extends transversely from said intermediate region to said medial surface of said respective annular ear pad;

said second region and said intermediate region of each of said top surfaces define a recess in a superior, medial portion of each of said first annular ear pad and said second annular ear pad; and each of said recesses facilitates the positioning of an article therein and in contact with said user's head, without breaking contact between said contact surfaces of said first and second annular ear pads and said user's head around said ears of said user.

11. The headset of claim 10, wherein each said second region of said respective top surface has a width sufficient to accommodate an eyewear temple.

12. The headset of claim 11, wherein each said second region of said respective top surface is contoured to engage an inferior surface of an eyewear temple.

13. The headset of claim 10, wherein a portion of each said intermediate region of said top surface of said respective annular ear pad remains spaced apart from said user's head when said medial surfaces are in contact with said user's head.

14. The headset of claim 10, wherein each of said first annular ear pad and said second annular ear pad includes an annular wall adjacent said medial surface and configured to completely surround said respective ear of said user.

15. The headset of claim 14, wherein said annular walls include sound attenuating material.

16. The headset of claim 14, wherein a thickness of an inferior portion of each said annular wall is greater than a thickness of a superior portion of each said annular wall.

17. The headset of claim 10, wherein each of said first annular ear pad and said second annular ear pad is coupled to a respective one of said first ear piece and said second ear piece by an adhesive.

18. The headset of claim 10, wherein each of said first annular ear pad and said second annular ear pad is removably coupled to a respective one of said first ear piece and said second ear piece by a respective mechanical fastener.

19. A method for manufacturing an ear pad, said method comprising:

providing a backing including a lateral surface configured to be coupled to a headset;

providing a shell of an annular body, said shell including a lateral perimeter, a top surface, and a medial surface, said medial surface including a continuous contact surface configured to contact a user's head completely around an ear of said user, said top surface including a first region, a second region, and an intermediate region, said first region extending transversely from said lateral perimeter toward said medial surface, said intermediate region extending downwardly from said first region to said second region, said second region extending transversely from said intermediate region to said medial surface;

filling said shell to form an annular body having a recess in a superior, medial portion of said annular body defined by said second region and said intermediate region of said top surface, said recess being configured to facilitate the positioning of an article therein and in contact with the user's head, without breaking contact between said contact surface and said user's head around said ear of said user; and coupling said backing to said lateral perimeter of said shell to fix said annular body between said lateral surface and said medial surface.

20. A method for manufacturing a headset, said method comprising:

providing a frame having a first, a second end, and an intermediate portion disposed therebetween;

providing an ear piece coupled to said first end of said frame;

providing an ear pad including a lateral surface, a medial surface including a continuous contact surface configured to engage a user's head completely around an ear of said user, and a top surface extending between said lateral surface and said medial surface, said top surface having a first region, a second region, and an intermediate region, said first region extending transversely from said lateral surface toward said medial surface, said intermediate region extending downwardly from said first region to said second region, said second region extending transversely from said intermediate region to said medial surface, said intermediate region of said top surface and said second region of said top surface, together, defining a recess adjacent said medial surface, said recess facilitating the positioning of an article therein and in contact with said user's head, without breaking contact between said medial surface and said user's head around said ear of said user; and attaching said lateral surface of said ear pad to said ear piece.

* * * * *